United States Patent [19]

Minezaki et al.

[11] 4,204,648

[45] May 27, 1980

[54] STRAND CUTTING DEVICE FOR CONTINUOUS GLASS FIBER WINDING APPARATUS

[75] Inventors: Hisao Minezaki; Akio Haneda; Asanori Masaki; Takeo Hanzawa; Yukio Uchiike, all of Fukushima, Japan

[73] Assignee: Nitto Boseki Co., Ltd., Fukushima, Japan

[21] Appl. No.: 2,000

[22] Filed: Jan. 8, 1979

Related U.S. Application Data

[63] Continuation-in-part of Ser. No. 835,277, Sep. 21, 1977, abandoned.

[30] Foreign Application Priority Data

Sep. 28, 1976 [JP] Japan ..... 51/116157

[51] Int. Cl.[2] ..... B65H 54/02; B65H 67/04

[52] U.S. Cl. ..... 242/18 A; 242/18 G; 242/19; 242/48

[58] Field of Search ..... 242/18 A, 18 G, 19, 242/18 R, 48; 139/302; 83/177, 909, 924; 65/11 R, 11 W

[56] References Cited

U.S. PATENT DOCUMENTS

| | | | |
|---|---|---|---|
| 2,391,870 | 1/1946 | Beach | 242/18 G |
| 3,090,570 | 5/1963 | Cunningham et al. | 242/18 G |
| 3,109,602 | 11/1963 | Smith | 242/18 A |
| 3,279,709 | 10/1966 | Carlson et al. | 242/18 A |
| 3,279,904 | 10/1966 | Russell et al. | 242/18 G |
| 3,640,163 | 2/1972 | Giardini et al. | 83/924 |

FOREIGN PATENT DOCUMENTS

| | | | |
|---|---|---|---|
| 1071073 | 6/1967 | United Kingdom | 242/18 A |

*Primary Examiner*—Stanley N. Gilreath
*Attorney, Agent, or Firm*—Sughrue, Rothwell, Mion, Zinn and Macpeak

[57] ABSTRACT

A stream of water 18 from a nozzle 17 is laterally directed against a glass fiber strand bridge 16 formed between a loaded spool 5 and an empty spool 4 as a turntable 1 rotatably mounting the two spools is indexed 180° to reverse the positions of the spools between standby and winding stations. The water discharge is synchronized with the turntable rotation, and cleanly severs the strand while in the wet state and winding continues on the empty spool while the loaded spool is removed and replaced with a new empty spool.

5 Claims, 3 Drawing Figures

STRAND CUTTING DEVICE FOR CONTINUOUS GLASS FIBER WINDING APPARATUS

REFERENCE TO PRIOR APPLICATION

This application is a continuation-in-part of application Ser. No. 835,277 filed on Sept. 21, 1977, now abandoned.

BACKGROUND OF THE INVENTION

This invention relates to a strand cutting device for a continuous glass fiber winding apparatus wherein a fully wound spool is rotationally indexed to a standby position and simultaneously replaced by an empty spool, and in which the glass fiber strand bridging the loaded and empty spools is clearly severed to enable the removal of the loaded spool and its replacement by a new empty spool.

In a conventional continuous strand winding apparatus, a loaded or fully wound spool is moved from the winding position to a standby position and replaced by an empty spool, and the strand length that is thus formed between the end sections of the spools must therefore be cut so that the winding operation may continue on the new or empty spool. In the prior art such strand cutting has been implemented by applying tension to the bridging strand, as by changing the relative rotational speeds of the two spools using a brake on the empty spool, or by applying a cutting edge to the strand. Both methods require an intricate and costly turntable mechanism, however, and are further disadvantageous in that they cause the severed ends of the strand to become markedly fluffed and split.

Accordingly, it is an object of this invention to provide a glass fiber strand cutting and winding system that does not require differential rotational speeds of the winding spools.

Yet another object of this invention is to provide a fiber strand cutting system using tap water to sever the strands.

A further object of this invention is to provide a system for cutting and winding glass fiber strands in the wet state.

Still another object of this invention is to provide a glass fiber strand cutting and winding system that is simple to construct and use yet eliminates the disadvantages of the prior art.

SUMMARY OF THE INVENTION

According to this invention it is unnecessary to establish a rotational speed difference between the loaded and empty spools, and no strand cutting edge is necessary. More specifically, the glass fiber strand is severed in a wet state by merely directing a stream of water at tap pressure to the length of the strand bridging the two spools, which produces a sharp cut-off and avoids any lateral fluffing or end splitting perpendicular to the strand direction. The flow of water is synchronized with the rotation of the spools. The overall construction of the cutting device is thus relatively simple, and does not in any way interfere with the structure or functioning of the turntable or its indexing mechanism.

DETAILED DESCRIPTION OF THE PREFERRED EMBODIMENT

Figure 1:
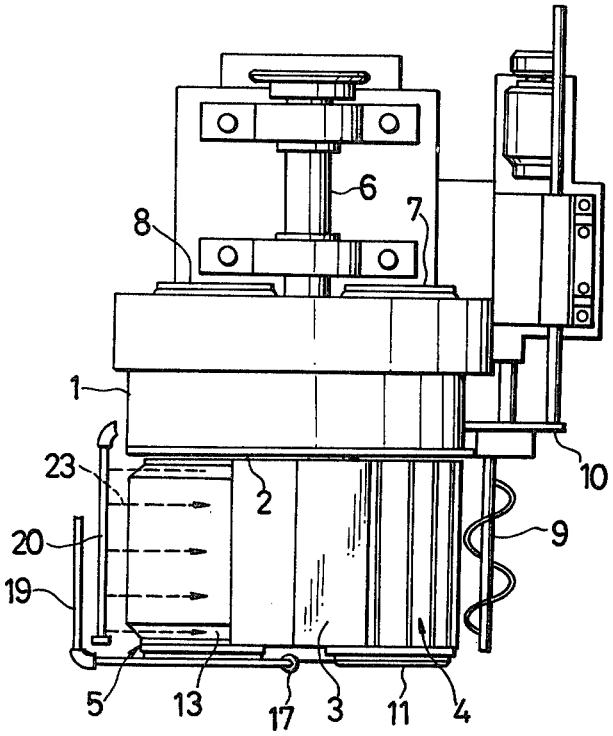
FIG. 1 shows a plan view of a glass fiber strand cutting and winding apparatus according to this invention.

This invention relates to strand cutting of continuous glass fibers. Prior to cutting, the glass fibers are formed by drawing from a glass melting furnace 30 using bushing orifices 32. The individual fibers are then coated at a coating station 36 by means of roll 38 with lubricants and coating agents and passed to a binder 40 where they are gathered to form a strand 12. In this condition, coated with the coating agents and lubricants, the strand 12 is delivered to the cutting section for severing while still in the wet state.

Referring to the accompanying drawing, the outer end surface 2 of a turntable 1 is divided into two symmetrical areas or work stations by a separator 3, although three or more such areas could also be provided. Winding spools 4, 5 of the cage bar type are removably mounted on the turntable at each of the respective work areas. The turntable 1 is intermittently rotated 180° by a driven shaft 6 such that when one of the spool mounts is at a strand winding position the other spool mount is at a standby position. Thus, when a spool becomes fully wound at the winding position it is rotated or advanced to the standby position and simultaneously replaced by an empty spool at the winding position. The spools 4 and 5 are each rotated in a clockwise winding direction by respective drive devices 7 and 8.

Reference numeral 9 designates a strand traversing or level wind device, and reference numeral 10 designates a strand guide device that operates to guide the incoming strand 12 onto an end section 13 of the spool 5 when the latter becomes fully wound. At approximately the same time the turntable drive is actuated to rotate the loaded spool 5 to the standby position and simultaneously deliver an awaiting empty spool 4 to the winding position. Such turntable rotation or indexing automatically introduces the strand 12 to the end section 11 of the new spool 4, whereat it forms a bridging strand length 16 spanning the gap between the ends of the spools 4, 5. The end sections 11, 13 comprise reduced diameter portions of the spools.

As in the conventional device, the end surface of the separator 3 is recessed from the end surfaces 14 and 15 of the spools 4 and 5, respectively, so that the strand 12 can be bridged in a straight line between the end sections 11, 13 as the turntable 1 is being rotated. After the strand bridge 16 is severed the loaded spool 5 at the standby position is removed and replaced by an empty or new spool. The cut ends of the strands adhere to their respective spools owing to both the laminar circular air flow established around the peripheral surface of the rapidly turning spools and stickiness caused by the fact that the strands are in a wet state from the lubricants and coating agents applied to the glass fibers during their draw forming.

According to this invention the strand bridge is cut-off during the continuous winding operation by a water stream 18 from a nozzle 17 disposed perpendicular to the direction of the strand bridge, whereby the water stream impinges on the strand bridge at a right angle.

Figure 2:
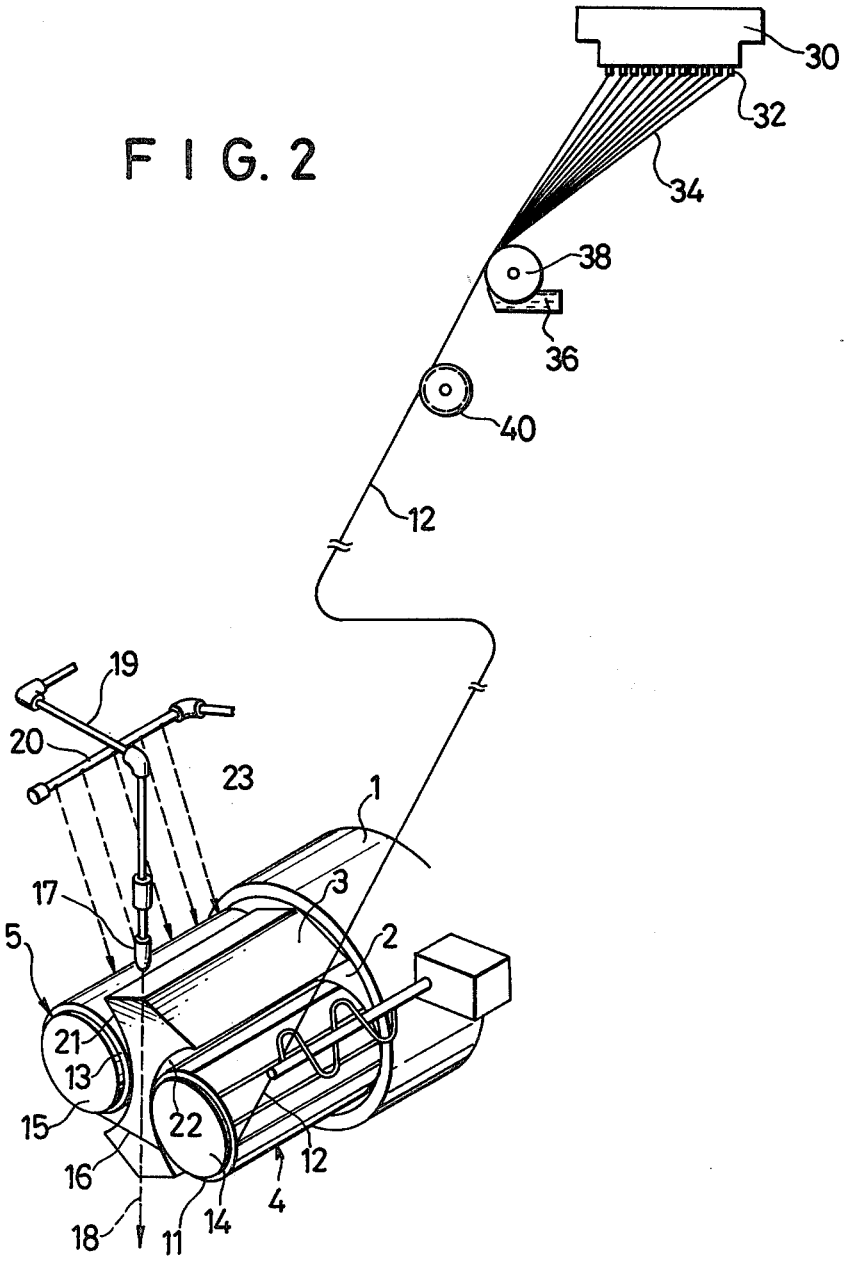
FIG. 2 shows a perspective view of the apparatus of FIG. 1.

The nozzle 17 is fixedly secured to the frame of the apparatus by a supply pipe 19 connected to an ordinary water source (not shown). The water supply is actuated by a control device, to be described herein in synchronization with the intermittent rotation and stop of the turntable, such that immediately after the turntable is at rest, as shown in FIG. 2, the water discharge stream is initiated.

As will be described in greater detail, the nozzle 17 should be in the range of 5–10 mm, inside diameter to effectuate cutting using ordinary tap water pressure. Generally, tap water pressure is in the range of 1.0 to 3.0 kg/cm$^2$, and in this invention it is preferable that the pressure be 1.5 to 2.0 kg/cm$^2$. It is apparent that such pressure regulation is easily achieved using appropriate valving the like. Also, the nozzle should be positioned to the frame at a distance of 300–400 mm from the strand bridge 16 to insure proper directivity of the stream without dispersion. This distance range will also be discussed herein.

Reference numeral 20 designates an apertured pipe for discharging cleaning water onto the concave sidewalls 21 or 22 of the separator 3. Lubricants, surface coating agents, etc. applied to the glass fiber strand during its draw forming operation are liable to adhere to the sidewalls of the separator during winding, and frequent cleaning is thus required. It is preferable to avoid wetting the strand being wound during the cleaning operation, whereby the pipe 20 is mounted parallel to the separator 3 at the standby position so that the water discharge ports 23 only strike the sidewall 21 thereat.

Figure 3:
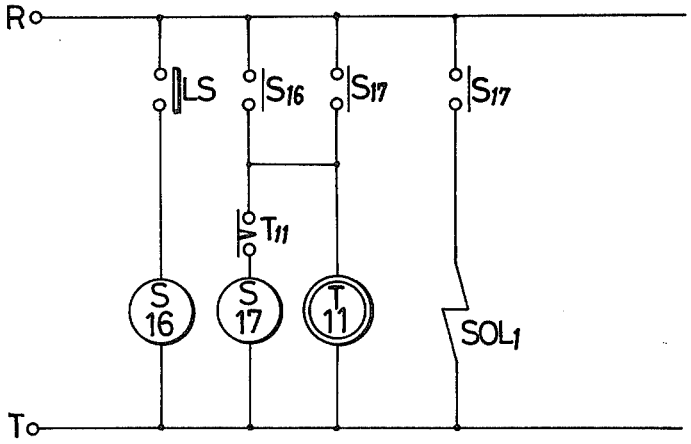
FIG. 3 is a circuit drawing showing the synchronization circuit for the water stream discharge with spool rotation.

Referring now to FIG. 3, the synchronization circuit for cycling water discharge with turntable rotation is shown. The circuit is coupled to a power source (not shown). Just prior to completion of a turntable rotation cycle, a limit switch LS is closed to energize relay $S_{16}$. The connector $S_{16}$ of the relay $S_{16}$ is closed. Next a timer $T_{11}$ is energized to close connector $T_{11}$ and finally relay $S_{17}$ is energized to close connecting point $S_{17}$. As a result, an electromagnetic valve SOL, is opened to allow the passage of water through nozzle 17. After a predetermined time interval, generally 3–5 seconds, as set in the timer $T_{11}$ the water discharge is terminated.

This is accomplished since timer $T_{11}$ will be deenergized to release contact $T_{11}$. The relay $S_{17}$ will then be de-energized opening contact point $S_{17}$. As a result SOL, will be de-energized and the water from the source will be disconnected from the nozzle. At the completion of the rotational cycle of the turntable, limit switch LS is opened to deenergize relay $S_{16}$ and connect point $S_{16}$ is opened. The cycle may then be repeated.

The mechanism whereby the strand 16 is cleanly severed by the water stream 18 in a perpendicular sectional plane is related to the wet state of the stand. It is believed probable that the cutting action derives from the low shear force resistance property of glass fibers that are wound without drying on the spools.

The cutting of the strand is independent of the tension applied to the strand bridge 16, and is effectuated as long as the strand bridge is laid in a straight line between the two spools. Thus, the cutting action takes place even through the two spools are rotated at equal speeds. This avoids a drawback of the prior art tension severing method, whereby the empty spool must be braked and thereafter brought up to full winding speed again, which disrupts the smooth continuity of the winding operation.

Various experiments have been conducted winding glass fiber strands having weights of 80, 160 and 320 gms./kg. under the conditions set forth below.

First, the inside diameter of the nozzle 17 was set at 8 mm, the distance between the end of the nozzle and the strand bridge 16 was 370 mm, and the water stream was allowed to strike the strand bridge under a pressure of 1.5– 2.0 kg/cm$^2$. Different size strands were sharply severed in 3–5 seconds by the water stream, and thereafter continued to be wound on the empty spools.

When the inside diameter of the nozzle was reduced to 3 mm the strands could not be cut because of an insufficient quantity of water. When the nozzle diameter was increased to 5 mm cutting could be achieved, but it was necessary to precisely control the direction of the water stream such that it was accurately centered on the strand bridge 16.

In contrast, when the nozzle diameter was increased to more than 10 mm the quantity of water was too great, as a result of which the severed strand was caused to swing and it was impossible to wind it on the empty spool.

At the stated water pressure of a range 1.5 to 2.0 kg/cm$^2$, the best results were obtained with an inside nozzle diameter on the order of 8 mm.

When the distance between the end of the nozzle and the strand bridge was reduced to 250 mm the water stream pressure was too high, whereby the severed strand was caused to swing and it could not be wound on the empty spool. On the other hand, when the distance was set at 450 mm the water stream discharge pressure was too low to achieve efficient strand cutting. Thus, with the given water pressure and nozzle diameter parameters, the most suitable distance between the end of the nozzle and the strand bridge was found to be 300–400 mm.

It is apparent that modifications of this invention are possible without departing from the essential scope of this invention.

What is claimed is:

1. A continuous glass fiber strand winding system comprising; a turntable, a pair of rotatably driven spools mounted on the turntable at winding and standby positions, means for continuously supplying a coated, wet glass fiber strand to the spool at the winding position for winding thereon, means for rotating the turntable when the spool at the winding position becomes fully loaded to thereby index the loaded spool to the standby position and an empty spool to the winding position and simultaneously form a wet bridge strand between the loaded and empty spools, and means for severing the bridge strand while in a wet state to enable continued winding on the empty spool, said means for severing comprising:

(a) a nozzle disposed adjacent the bridge strand and oriented such that a water discharge stream supplied therefrom laterally strikes the wet bridge strand in a substantially perpendicular direction, (b) means for supplying pressurized water to the nozzle to sever the wet bridge strand, and (c) means to synchronize the supply of water to said nozzle with the rotation of the turntable.

2. The system of claim 1 wherein said means to synchronize comprises a timer having a cycle time set to be substantially equal to the time necessary to cut said wet bridge strand, relay means operative in response to said timer and a solenoid operative in response to said relay means to selectively initiate and terminate the supply of water to said nozzle.

3. The system of claim 2 wherein said means to synchronize further comprises sensor means responsive to indexing of said spools and a relay in series with said sensor means to energize said timer.

4. The system of claim 1 further comprising means to clean a portion of said turntable prior to loading an empty spool thereon.

5. The system of claim 1 wherein said means to clean comprises a discharge pipe positioned adjacent said turntable standby position, said discharge pipe having an ejection port for directing a stream of water onto a portion of said turntable where said empty spool is to be mounted.

* * * * *